United States Patent [19]

Mondt et al.

[11] Patent Number: 4,795,616

[45] Date of Patent: Jan. 3, 1989

[54] CATALYTIC CONVERTER MONOLITHIC SUBSTRATE RETENTION

[75] Inventors: James R. Mondt, Pontiac; Ricky P. Schacher, Flint, both of Mich.

[73] Assignee: General Motors Corporation, Detroit, Mich.

[21] Appl. No.: 63,676

[22] Filed: Jun. 19, 1987

[51] Int. Cl.[4] ..... F01N 3/10; F01N 3/28; B01D 53/36; B01J 8/02

[52] U.S. Cl. ..... 422/179; 422/180; 422/221; 422/222; 422/311; 55/475; 55/491; 55/496; 55/517

[58] Field of Search ..... 422/179, 180, 221, 222, 422/311; 55/491, 517, 480, 496, 492, 475

[56] References Cited

U.S. PATENT DOCUMENTS

| | | | |
|---|---|---|---|
| 4,152,302 | 5/1979 | Nonnenmann et al. | 252/472 |
| 4,237,099 | 12/1980 | Alley et al. | 422/179 X |
| 4,238,454 | 12/1980 | Roberts et al. | 422/179 X |
| 4,248,833 | 2/1981 | Aoyama | 422/179 |
| 4,254,085 | 3/1981 | Wilson, Jr. et al. | 422/171 |
| 4,352,783 | 10/1982 | Bailey | 422/180 X |

*Primary Examiner*—Benoit Castel
*Assistant Examiner*—Lynn M. Kummert
*Attorney, Agent, or Firm*—R. L. Phillips

[57] ABSTRACT

A monolithic catalytic converter has a two-piece slip pin that extends through a monolithic substrate and is connected at its opposite ends to the housing so as to retain the substrate therein while freely allowing differential thermal expansion between the slip pin and the housing to accommodate thermal mismatch between these components.

7 Claims, 1 Drawing Sheet

CATALYTIC CONVERTER MONOLITHIC SUBSTRATE RETENTION

TECHNICAL FIELD

This invention relates to catalytic converter monolithic substrates and more particularly to the retention of such substrates.

BACKGROUND OF THE INVENTION

The retention of a monolithic substrate in a catalytic converter housing presents a difficult technical problem because of the high temperatures and pulsating flow conditions in the exhaust gas stream from an automotive engine. And these conditions are especially severe for converters mounted close to, or directly as part of the exhaust manifold.

Prior attempts at solving this problem have used retaining lips at the ends of the housing to capture the substrate at the peripheral end edges thereof. While this has proven to be generally satisfactory for ceramic substrates, such is not the case with monolithic metal foil substrates. Typically, such monolithic metal foil substrates are formed by either spirally wrapping the foil, folding a continuous sheet or stacking individual sheets. Where the layers are formed by either stacking or folding, each layer is effectively trapped by the conventional retaining rings, however, in the case where the layers are formed by spiral wrapping, it has been found that the layers inward of such retaining rings may telescope due to the pressure drop forces. Moreover, regardless of how the metal foil layers are formed, it has been found that the foil may shear at the retaining lip-to-foil interface and may also crack in both the longitudinal and transverse directions. Furthermore, there may occur retainer lid deformation as a result of vibrations and flow pulsations acting on the substrate which in turn impacts the lip and can result in substrate movement whether the lip is wide or narrow. As a result, it has been the practice to weld or otherwise attach the layers together such as with staples or integral barbs and to also add further retention means such as cross-wise pieces or bars at the ends of the foil layers.

It is also known to provide retention of a monolithic substrate, either ceramic or metal, by employing one or more solid pins inserted through the monoliths. These pins pass through the substrate across the housing and are attached to the latter to resist axial pressure drop forces tending to force the substrate out of the housing and to prevent those layers such as in a spiral wrap from telescoping. Typically, these pins are welded at their ends to opposite sides of the housing and serve either as a supplementary restraint or in lieu of retainer lips to eliminate the shearing effect of the latter. However, it has been found that differential thermal expansion can cause distortions when such pins are used. In use, the pin is exposed directly to exhaust gas and consequently is heated to a higher temperature than the housing because the pin has limited access to a heat sink. In contrast, the housing is exposed directly to ambient air flow and associated cooling heat transfer.

Because the pin is heated to a temperature higher than that of the housing, thermal expansion causes the pin length to be greater than the cross-wise dimension of the housing. This thermal growth mismatch must be accommodated, either by thermal strain within the parts, or by thermal distortion of the parts. Thermal distortion of either the housing or the pin is undesirable because parts no longer fit so leakage or looseness, or both can result.

SUMMARY OF THE INVENTION

The present invention accommodates this thermal mismatch with a slip pin that is fixed at its opposite ends to the housing like before but now comprises two slip fitting parts that can slip relative to each other within the substrate to allow for the differential thermal expansion. The slip pin may take various forms as described in detail later and in each case permit freedom of growth of the pin along its length dimension without forcing a dimensional mismatch in the corresponding portion of the housing and while maintaining all the layers of the substrate captured. Moreover, it will be seen that the slip pin embodiments are readily adaptable in any desired number to various locations in a catalytic converter.

These and other objects, features and advantages of the present invention will become more apparent from the following description and drawing in which:

DETAILED DESCRIPTION OF THE DRAWINGS

Figure 1:
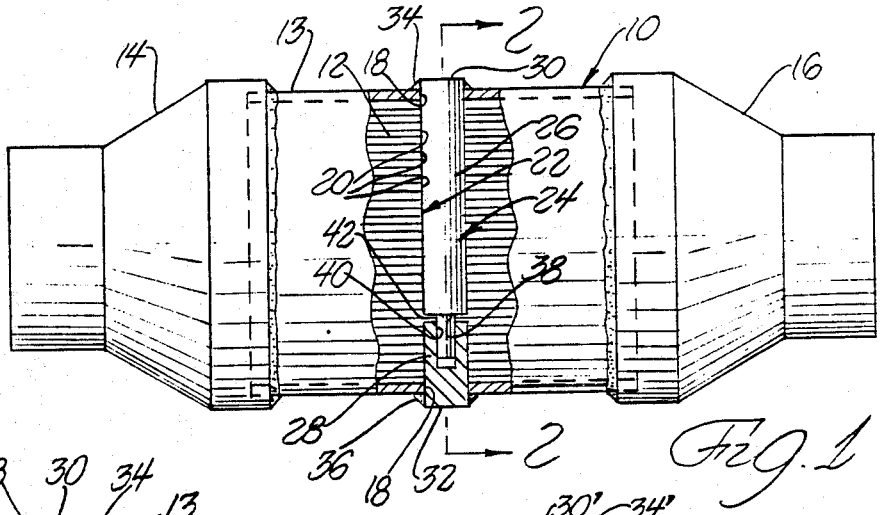
FIG. 1 is a side view with parts broken away of a monolithic type catalytic converter having a slip pin according to the present invention.
Figure 2:
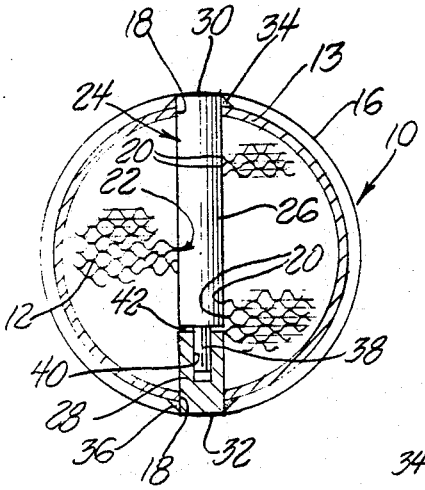
FIG. 2 is a view taken along the line 2—2 in FIG. 1.

Referring to FIGS. 1 and 2, there is shown a monolithic catalytic converter 10 for treating the exhaust gases from an internal combustion engine powering a vehicle. The catalytic converter generally comprises a monolithic substrate 12 that following coating with a suitable catalyst is mounted and must be retained in a cylindrical housing 13 to which a pair of conical-shaped pipes 14 and 16 are welded at the opposite ends thereof, the latter forming an inlet and an outlet for the exhaust gases to pass through the coated monolithic substrate. The substrate and housing have in cross-section a right circular cylindrical shape; however, it will be understood that the cross-section may take other forms such as oval and kidney-shape to meet various accommodating space requirements in a vehicle. Moreover, it will be understood that the monolithic substrate in this converter is formed of layers of metal foil which may either be stacked as shown or folded or spirally wound and provide the most difficult problem of retention as compared with a ceramic monolith where slippage is not possible between the passage forming walls. It will also be understood that the metal foil layers are not secured together such as by brazing or welding or any other attachment means other than the retaining pin shown. However, retaining lips could be added to the housing at opposite ends of the substrate for additional retention.

Retention of the metal foil monolithic substrate is provided by forming aligned perforations 18 through opposite sides of the housing and like perforations 20 through all the layers of the substrate. In this embodiment, the perforations form a round hole 22 extending through the substrate layers and the opposite sides of the housing. A two-piece slip pin 24 is inserted in the hole 22 with a close fit and comprises a relatively long cylindrical pin member 26 and a short pin member 28 of the same diameter. The two-piece slip pin is fixed at its opposite ends 30 and 32 to the housing by welds 34 and 36 made externally thereof. On the other hand, the opposite or inner ends of the slip pin are formed with a reduced diameter portion 38 on the long pin member 26 that is slidably received in a round blind bore or hole 40 in the short pin member. End clearance 42 is provided between the inner ends of the two pin members in their normal or ambient state when assembled and the slip pin engagement of the reduced diameter pin portion 38 in the pin hole 40 operates to permit freedom of growth of the pin along its length without forcing a dimensional mismatch with the housing while the cylindrical external surfaces of the two pin members 26 and 28 operating in the metal foil holes 20 positively prevent any movement between the metal foil layers and relative to the housing in response to axial pressure drop forces tending to force the substrate out of the housing.

Figure 3:
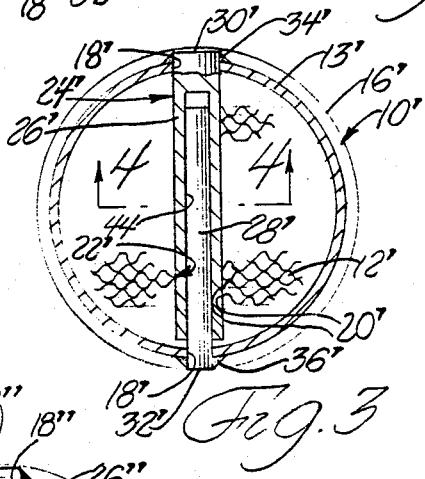
FIG. 3 is a view like FIG. 2 but of another embodiment of the slip pin according to the present invention.
Figure 4:
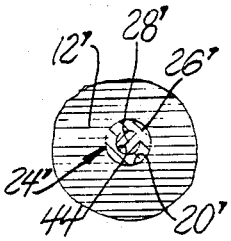
FIG. 4 is a view taken along the line 4—4 in FIG. 3.

Another embodiment of the slip pin is shown in FIGS. 3 and 4 wherein the same numerals only primed are used to identify parts similar to those in the FIGS. 1 and 2 embodiment and new numerals are used to identify significant differences. In this embodiment, the upper pin member 26′ rather than having a reduced diameter portion now extends completely across the substrate and has a long blind bore 44 formed therein to accommodate the lower pin member 28′ which is now a solid piece of smaller diameter sized to be slidably received therein.

Figure 5:
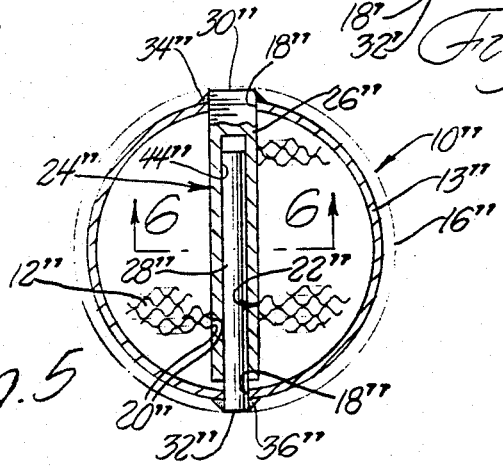
FIG. 5 is a view like FIG. 2 but of another embodiment of the slip pin according to the present invention.
Figure 6:
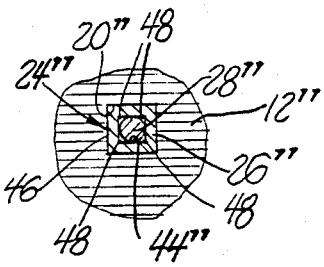
FIG. 6 is view taken along the line 6—6 in FIG. 5.

In the embodiment shown in FIGS. 5 and 6, wherein parts similar to those in FIGS. 1–4 are identified by the same numerals only double primed and new numerals are used to identify significant differences, provision is made in the slip pin 24″ to insure continued free sliding engagement even in the event of extensive oxide buildup at the contacting surfaces. This is accomplished by providing an upper pin member 26″ like in FIG. 3 but with a square-shaped exterior 46 and hole 44″ while retaining the round lower pin member 28″ and in addition, conforming the perforations 20″ in the substrate to the now square-shaped cross-sectional profile 46 of the upper pin member. As seen in FIG. 6, with the round pin 28″ operating in the square hole 44″, there is provided corner clearances 48 to accommodate the accumulation of oxide in the slip joint.

Figure 7:
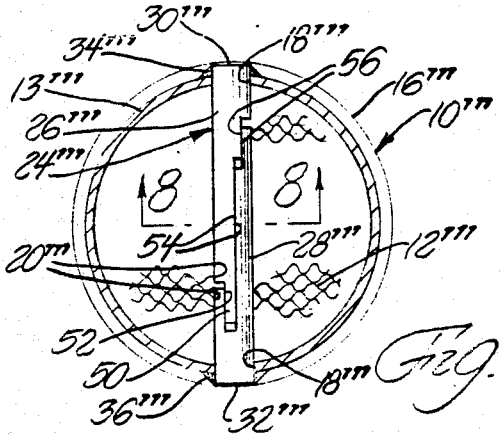
FIG. 7 is a view like FIG. 2 but of another embodiment of the slip pin according to the present invention.
Figure 8:
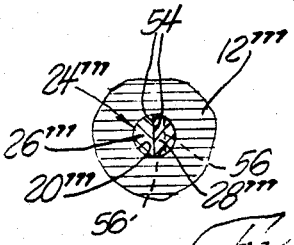
FIG. 8 is a view taken along the line 8—8 in FIG. 7.

In the embodiment shown in FIGS. 7 and 8, parts similar to those shown in FIG. 2 are identified by the same numerals only triple primed and new numerals are used to identify significant differences. In this case, the slip pin 24‴ is designed so as to be readily manufactured with a forming operation such as cold-forming or forging. To this end, both pin members 26‴ and 28‴ have the same outer diameter but now the upper pin is provided with an axially extending tongue 50 that is received in a rectangular slot 52 in the lower pin to maintain their alignment. In addition, both pin members are provided with a long and short pair of axially extending parallel flats 54 and 56 that slidably contact to accommodate relative pin member movement while providing substantial full cylindrical contact at their external surface with the metal foil as seen in FIG. 8.

The above described preferred embodiments are illustrative of the invention which may be modified within the scope of the appended claims.

The embodiments of the invention in which an exclusive property or privilege is claimed are defined as follows:

1. A catalytic converter comprising a housing with an inlet and an outlet, a monolithic substrate arranged in said housing between said inlet and outlet, aligned perforations in said housing and said substrate forming a hole extending laterally through and across said substrate and through opposite sides of said housing, and slip pin means comprising at least two relatively freely movable parts extending through said hole and fixed at opposite ends to said housing for retaining said monolithic substrate in said housing while freely permitting relative thermal expansion between said pin means and said housing by free relative movement between said at least two parts of said slip pin means.

2. A catalytic converter as defined in claim 1 wherein said slip pin means comprises two round pin members of equal diameter that are each fixed at one of two ends thereof to said housing, a second end of one of said members having a reduced diameter pin portion slidably received in an axial bore in the second end of the other of said members.

3. A catalytic converter as defined in claim 1 wherein said slip pin means comprises two round pin members of unequal diameter, the largest diameter pin member extending through said substrate and having an axial bore slidably receiving the other pin member.

4. A catalytic converter as defined in claim 1 wherein said hole is square and said slip pin means comprises two pin members, one of said pin members being round and the other of said pin members extending through said substrate and having a square hole slidably receiving said round pin member and a square exterior profile corresponding to that of said hole through said substrate.

5. A catalytic converter as defined in claim 1 wherein said slip pin means comprises two pin members having an axially extending tongue and slot coupling to maintain alignment of said pin members and further having axially extending parallel interfacing flats that slidably contact to guidingly accommodate relative pin member movement while leaving the outer surface of said pin members free to fully contact said substrate.

6. A catalytic converter as defined in claim 5 wherein said hole is round and said two pin members having exterior sides that cooperate to form a round surface corresponding to said round hole.

7. A catalytic converter comprising a housing with an inlet and an outlet, layers of metal foil arranged in said housing so as to form a monolithic substrate between said inlet and outlet, aligned perforations in said layers of foil and said housing forming a hole extending laterally through and across said layers and through opposite sides of said housing, and slip pin means comprising only two relatively freely movable parts extending through said hole and fixed at opposite ends to said housing for retaining said layers against movement in said housing and against movement with respect to each other while freely permitting relative theremal expansion between said pin means and said housing by free relative movement between said two parts of said slip pin means.

* * * * *